US010993473B2

(12) United States Patent
Malgat et al.

(10) Patent No.: US 10,993,473 B2
(45) Date of Patent: May 4, 2021

(54) THERMAL LAMINATE RODS FOR USE IN AEROSOL-GENERATING ARTICLES

(71) Applicant: Philip Morris Products S.A., Neuchatel (CH)

(72) Inventors: Alexandre Malgat, Les Tuileries de Grandson (CH); Stephane Roudier, Colombier (CH); Ana Carolina Borges De Couraca, Lausanne (CH); Frederic Lavanchy, Chavornay (CH); Cedric Meyer, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 750 days.

(21) Appl. No.: 15/101,269

(22) PCT Filed: Dec. 4, 2014

(86) PCT No.: PCT/EP2014/076651
§ 371 (c)(1),
(2) Date: Jun. 2, 2016

(87) PCT Pub. No.: WO2015/082653
PCT Pub. Date: Jun. 11, 2015

(65) Prior Publication Data

US 2016/0309781 A1 Oct. 27, 2016

(30) Foreign Application Priority Data

Dec. 5, 2013 (EP) ..... 13195904

(51) Int. Cl.
*A24F 47/00* (2020.01)
*A24F 42/00* (2020.01)
(Continued)

(52) U.S. Cl.
CPC ..... *A24F 47/008* (2013.01); *A24D 1/02* (2013.01); *A24F 42/00* (2020.01); *A24F 42/10* (2020.01); *A24F 47/006* (2013.01); *A62C 3/00* (2013.01)

(58) Field of Classification Search
CPC ..... A24F 47/008; A24F 47/006; A62C 3/00; A24D 1/02
See application file for complete search history.

(56) References Cited

U.S. PATENT DOCUMENTS 5,065,776 A 11/1991 Lawson et al.
5,169,481 A * 12/1992 Braunshteyn ..... A24C 5/46 131/252

(Continued)

FOREIGN PATENT DOCUMENTS

CH 691 156 A5 5/2001
CN 1059265 A 3/1992

(Continued)

OTHER PUBLICATIONS

WO-2010113702-A1 (Machine Translation) [online], [retrieved on Aug. 3, 2020], retrieved from Espacenet (https://worldwide.espacenet.com/patent/) (Year: 2010).*

(Continued)

*Primary Examiner* — Michael H. Wilson
*Assistant Examiner* — Yana B Krinker
(74) *Attorney, Agent, or Firm* — Oblon, McClelland, Maier & Neustadt, L.L.P.

(57) ABSTRACT

A rod and a method of forming a rod are provided. The rod includes a gathered sheet of material circumscribed by a wrapper, in which the sheet of material is a co-laminated sheet comprising a layer of an aerosol-forming material and a layer of a thermally-conductive material and in which the wrapper is a metal foil. The method includes providing a (Continued)

continuous co-laminated sheet including an aerosol-forming material and a thermally-conductive material; gathering the co-laminated sheet transversely relative to its longitudinal axis; circumscribing the gathered co-laminated sheet with a metal foil wrapper to form a continuous rod; and severing the continuous rod into a plurality of discrete rods.

17 Claims, 3 Drawing Sheets

(51) Int. Cl.

| | |
|---|---|
| ***A24F 42/10*** | (2020.01) |
| ***A24D 1/02*** | (2006.01) |
| ***A62C 3/00*** | (2006.01) |

(56) References Cited

U.S. PATENT DOCUMENTS

| | | | | |
|---|---|---|---|---|
| 5,396,911 | A | 3/1995 | Casey, III et al. | |
| 6,367,481 | B1 * | 4/2002 | Nichols | A24D 1/00 131/331 |
| 2007/0215168 | A1 | 9/2007 | Banerjee et al. | |
| 2011/0192408 | A1 | 8/2011 | Inagaki et al. | |
| 2014/0305448 | A1 | 10/2014 | Zuber et al. | |
| 2014/0338686 | A1 * | 11/2014 | Plojoux | A24F 47/008 131/329 |

FOREIGN PATENT DOCUMENTS

| | | | | |
|---|---|---|---|---|
| CN | 1072576 | A | 6/1993 | |
| CN | 101557728 | A | 10/2009 | |
| EP | 0 822 670 | A2 | 2/1998 | |
| WO | WO 2008/108889 | A1 | 9/2008 | |
| WO | WO 2009/022232 | A2 | 2/2009 | |
| WO | WO 2010/047389 | A1 | 4/2010 | |
| WO | WO-2010113702 | A1 * | 10/2010 | A24B 15/165 |
| WO | WO 2012/164009 | A2 | 12/2012 | |
| WO | WO 2013/043299 | A3 | 3/2013 | |
| WO | 2013/098405 | A2 | 7/2013 | |
| WO | 2013/102609 | A2 | 7/2013 | |
| WO | WO 2013/102614 | A2 | 7/2013 | |
| WO | WO 2013/120849 | A1 | 8/2013 | |

OTHER PUBLICATIONS

International Search Report and Written Opinion of the International Searching Authority dated Mar. 4, 2015 in PCT/EP2014/076651 filed Dec. 4, 2014.

Combined Chinese Office Action and Search Report dated Jul. 16, 2018 in Chinese Patent Application No. 201480062724.7 (submitting English translation only), 9 pages.

Office Action dated Oct. 9, 2018 in Japanese Patent Application No. 2016-526291, 14 pages (with English translation).

Combined Australian Office Action and Search Report dated Mar. 13, 2018 in Australian Paten t Application No. 2014359188, 6 pages.

* cited by examiner

THERMAL LAMINATE RODS FOR USE IN AEROSOL-GENERATING ARTICLES

The present specification relates to rods comprising a co-laminated sheet comprising an aerosol-forming material a thermally-conductive material, the sheet being gathered and circumscribed by a wrapper to form a rod for use in aerosol-generating articles. The specification also relates to heated aerosol-generating articles comprising such rods having a lowered propensity for ignition, for example when brought into contact with a flame.

Aerosol-generating articles in which an aerosol-forming substrate, such as a tobacco containing substrate, is heated rather than combusted are known in the art. The aim of such heated aerosol-generating articles is to reduce known harmful smoke constituents produced by the combustion and pyrolytic degradation of tobacco in conventional cigarettes. A conventional cigarette is lit when a user applies a flame to one end of the cigarette and draws air through the other end. The localised heat provided by the flame and the oxygen in the air drawn through the cigarette cause the end of the cigarette to ignite, and the resulting combustion generates an inhalable smoke. By contrast in heated aerosol-generating articles, an inhalable aerosol is typically generated by the transfer of heat from a heat source to a physically separate aerosol-forming substrate or material, which may be located within, around or downstream of the heat source. During consumption, volatile compounds are released from the aerosol-forming substrate by heat transfer from the heat source and entrained in air drawn through the aerosol-generating article. As the released compounds cool, they condense to form an aerosol that is inhaled by the consumer.

Heated aerosol-generating articles comprising tobacco for generation of an aerosol by heating rather than burning are known in the art. For example, WO2013/102614 discloses an aerosol-generating system comprising a heated aerosol-generating article and an aerosol-generating device having a heater for heating the heated aerosol-generating article to produce an aerosol.

Tobacco used as part of an aerosol-forming substrate in heated aerosol-generating articles is designed to produce an aerosol when heated rather than when burned. Thus, such tobacco typically contains high levels of aerosol formers, such as glycerine or propylene glycol. If a user were to light a heated aerosol-generating article and smoke it as if it were a conventional cigarette that user would not receive the intended user experience. It would be desirable to produce a heated aerosol-generating article that has a lowered propensity for flame ignition. Such a heated aerosol-generating article would be preferably difficult to light during attempts to light the article with a lighter, such as a flame, in the manner of traditional cigarettes.

A rod may be provided comprising a gathered sheet of material circumscribed by a metal foil wrapper, in which the sheet of material is a co-laminated sheet comprising an aerosol-forming material and a thermally-conductive material. The rod may be termed an aerosol-generating rod.

Such a rod may be formed by a method comprising the steps of providing a continuous co-laminated sheet comprising an aerosol-forming material and a thermally-conductive material, gathering the co-laminated sheet transversely relative to its longitudinal axis, circumscribing the gathered co-laminated sheet with a metal foil wrapper to form a continuous rod, and severing the continuous rod into a plurality of discrete rods.

The metal foil wrapper may preferably be an aluminium foil wrapper.

Such a rod may be used as the aerosol-forming substrate of a heated aerosol-generating article. Preferably, the aerosol-generating article is a smoking article that generates an aerosol that is directly inhalable into a user's lungs through the user's mouth. More, preferably, the aerosol-generating article is a smoking article that generates a nicotine-containing aerosol that is directly inhalable into a user's lungs through the user's mouth.

The co-laminated sheet comprises a layer of aerosol-forming material in intimate contact with a layer of thermally-conducting material. If a heat source, such as a flame or other cigarette lighter, is applied to the rod, the thermally-conductive material conducts the heat away from the point of contact with the heat source. Thus, more thermal energy needs to be supplied in order to raise the temperature of the aerosol-forming material to its ignition point. Furthermore, as one side of the aerosol-forming material is in intimate contact with the thermally-conducting material, the surface area of aerosol-forming material that is in contact with oxygen from the air is lowered. This may further reduce the propensity for ignition of the aerosol-forming material within the rod.

The thermally-conductive material is preferably a non-flammable material. The thermally-conductive material is preferably a metal foil, such as aluminium foil. Aluminium foil is a highly efficient thermal conductor.

The aerosol-forming material preferably comprises tobacco. Preferred forms of tobacco may be classified as homogenised tobacco or cast-leaf tobacco or reconstituted tobacco.

The co-laminated sheet comprises at least one layer of aerosol-forming material and at least one layer of thermally-conductive material arranged in intimate contact with each other in the form of a single sheet. A preferred example of a co-laminated sheet comprises a layer of homogenised or cast-leaf tobacco formed on a surface of an aluminium foil.

The co-laminated sheet may comprise more than one layer of aerosol-generating material. The co-laminated sheet may comprise more than one layer of thermally-conductive material.

The rod may comprise one or more further sheets of material gathered together with the co-laminated sheet and circumscribed by a metal foil wrapper.

The gathered sheet of material preferably extends along substantially the entire rod length of the rod and across substantially the entire transverse cross-sectional area of the rod.

As used herein, the term 'rod' is used to denote a generally cylindrical element of substantially circular, oval or elliptical cross-section.

As used herein, the term 'sheet' denotes a laminar element having a width and length substantially greater than the thickness thereof. The width of a sheet is greater than 10 mm, preferably greater than 20 mm or 30 mm.

As used herein, the term "co-laminated sheet" denotes a single sheet formed from two or more layers of material in intimate contact with one another.

As used herein, the term "aerosol-forming material" denotes a material that is capable of releasing volatile compounds upon heating to generate an aerosol. An aerosol-forming substrate may comprise or consist of an aerosol-forming material.

As used herein, the term 'rod length' denotes the dimension in the direction of the cylindrical axis of rods as described herein.

As used herein, the term 'homogenised tobacco material' denotes a material formed by agglomerating particulate tobacco.

As used herein, the term 'gathered' denotes that the sheet of tobacco material is convoluted, folded, or otherwise compressed or constricted substantially transversely to the cylindrical axis of the rod.

As used herein, the terms 'upstream' and 'downstream' are used to describe the relative positions of components, or portions of components, of aerosol-generating articles comprising rods as described herein in relation to the direction of air drawn through the aerosol-generating articles during use thereof.

A rod as described above may be particularly beneficial as a component of a heated aerosol-generating article. The co-laminated sheet has an increased thermal conductivity which makes it more difficult to ignite. Thus, a user who applies a flame to such a rod when forming part of a heated aerosol-generating article may experience difficulty in igniting the aerosol-forming material. The user may therefore be discouraged from smoking the aerosol-generating article in an unintended way.

A further benefit of using a rod formed from a co-laminated sheet of aerosol-forming material and thermally-conductive material as an aerosol-forming substrate of a heated aerosol-generating article is that heat may be efficiently distributed from a heat source. Heated aerosol-generating systems operate by heating an aerosol-forming substrate to generate an aerosol from the material of the substrate. This aerosol can then be inhaled by a consumer. Typically, a sheet of aerosol-forming material, such as a sheet of homogenised tobacco, has low thermal conductivity. This means that it may be difficult to evenly heat a rod or plug formed from a sheet of aerosol-generating material. Differential heating may result in some portions of the rod or plug that are heated to a high temperature. These portions of the rod may scorch and release or evolve unpleasant-tasting volatile components, or volatile substances from these portions may be evolved and expended too quickly for a satisfactory user experience. Other portions of the rod or plug that are more remote from the heat source may not reach a sufficient temperature to evolve volatile substances.

An efficient thermal transfer, as provided by the co-laminated sheet within the rod, may mean that the operating temperature of a heat source for an aerosol-generating system can be reduced. This may have the beneficial effect of minimising scorching of any portion of the aerosol-generating substrate. Efficient thermal transfer may also mean that desirable volatile substances are evolved from the entire aerosol-forming substrate comprising an aerosol-forming material and a thermally conductive material. Thus, there may be more efficient utilisation of aerosol-forming material.

The co-laminated sheet of material may be a textured sheet of material. Use of a textured sheet of material may advantageously facilitate gathering of the sheet to form a rod as described herein.

As used herein, the term 'textured sheet' denotes a sheet that has been crimped, embossed, debossed, perforated or otherwise deformed. Textured sheets of material may comprise a plurality of spaced-apart indentations, protrusions, perforations or a combination thereof.

As used herein, the term 'crimped sheet' is intended to be synonymous with the term 'creped sheet' and denotes a sheet having a plurality of substantially parallel ridges or corrugations.

A number of aerosol-generating articles in which an aerosol-forming substrate is heated rather than combusted have been proposed in the art. Typically in heated aerosol-generating articles, an aerosol is generated by the transfer of heat from a heat source, for example a chemical, electrical or combustible heat source, to a physically separate aerosol-forming substrate, which may be located within, around or downstream of the heat source.

As used herein, the term 'aerosol-forming substrate' denotes a substrate consisting of or comprising an aerosol-forming material that is capable of releasing volatile compounds upon heating to generate an aerosol.

Rods as described herein are particularly suited for use as aerosol-forming substrates of heated aerosol-generating articles. Aerosol-forming substrates in heated aerosol-generating articles are typically significantly shorter in rod length than rods of combustible smokable material in conventional lit-end smoking articles.

In one embodiment, rods as described herein may be used as aerosol-forming substrates in heated aerosol-generating articles comprising a combustible heat source and an aerosol-generating substrate downstream of the combustible heat source.

For example, rods as described herein may be used as aerosol-generating substrates in heated aerosol-generating articles of the type disclosed in WO-A-2009/022232, which comprise a combustible carbon-based heat source, an aerosol-generating substrate downstream of the combustible heat source, and a heat-conducting element around and in contact with a rear portion of the combustible carbon-based heat source and an adjacent front portion of the aerosol-generating substrate. However, it will be appreciated that rods as described herein may also be used as aerosol-generating substrates in heated aerosol-generating articles comprising combustible heat sources having other constructions.

Thermal conduction facilitated by the co-laminated sheet of aerosol-forming material and thermally-conductive material may be particularly efficient along the longitudinal axis of the rod. Thus, heat from a combustible heat source located at one end of the rod may be more efficiently transferred to aerosol-forming material located downstream of the heating element. The more efficient heat transfer may allow the use of an aerosol-forming substrate of greater length, in other words a substrate that extends a greater distance away from the heat source. This may be desirable to increase the amount of usable aerosol-forming material that is present in the article.

In another embodiment, rods as described herein may be used as aerosol-generating substrates in heated aerosol-generating articles for use in electrically-operated aerosol-generating systems in which the aerosol-generating substrate of the heated aerosol-generating article is heated by an electrical heat source. Such heated aerosol-generating articles are frequently constructed having an aerosol-forming substrate at a distal end. Thus, a user may inadvertently attempt to light the article in a traditional manner. The reduced ignition propensity of the rods comprising a co-laminated sheet may advantageously dissuade a user from attempting to ignite the article.

As an example, rods as described herein may be used as aerosol-generating substrates in heated aerosol-generating articles of the type disclosed in EP-A-0 822 670.

A system may be provided comprising an electrically-operated aerosol-generating apparatus and an aerosol-generating article for use with the apparatus. The aerosol-generating article comprises a rod or an aerosol-forming substrate as described herein.

An electrically heated aerosol-generating system may apply a varied heating profile during consumption of an aerosol-generating article in order to optimise the user experience. The presence of a thermally-conductive layer in the co-laminated sheet may help the aerosol-generation to be more responsive to variations in the thermal energy applied by the heater.

Preferably, rods according to the specification are of substantially uniform cross-section.

Rods according to the specification may be produced having different dimensions depending upon their intended use.

For example, rods according to the specification may have a diameter of between about 5 mm and about 10 mm depending upon their intended use.

For example, rods according to the specification may have a rod length of between about 5 mm and about 150 mm depending upon their intended use.

In preferred embodiments, rods according to the specification for use as aerosol-forming substrates in heated aerosol-generating articles may have a rod length of between about 5 mm and about 20 mm or about 30 mm.

Rods according to the specification of a desired unit rod length may be produced by forming a rod of multiple unit rod length and then cutting or otherwise dividing the rod of multiple unit rod length into multiple rods of the desired unit rod length.

For example, rods having a rod length of about 15 mm for use as aerosol-forming substrates in heated aerosol-generating articles may be produced by forming a rod having a rod length of about 150 mm and then severing the elongate rod into ten rods having a rod length of about 15 mm.

Preferred embodiments comprise layers of homogenised tobacco material co-laminated with a thermally-conductive layer. In certain embodiments, layers of homogenised tobacco material may have a tobacco content of at least about 40% by weight on a dry weight basis or of at least about 50% by weight on a dry weight basis. In other embodiments, layers of homogenised tobacco material may have a tobacco content of about 70% or more by weight on a dry weight basis. Where rods according to the specification are intended for use as aerosol-forming substrates in heated aerosol-generating articles, the use of layers of homogenised tobacco material having high tobacco contents advantageously generates aerosols with enhanced tobacco flavour.

Layers of homogenised tobacco material may comprise one or more intrinsic binders, that is tobacco endogenous binders, one or more extrinsic binders, that is tobacco exogenous binders, or a combination thereof to help agglomerate the particulate tobacco. Alternatively, or in addition, layers of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets of homogenised tobacco material for use in forming a rod as described herein are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Homogenised tobacco material may comprise between about 1% and about 5% non-tobacco fibres by weight on a dry weight basis.

Suitable aerosol-formers and humectants for inclusion in layers of homogenised tobacco material are known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

For example, where rods according to the specification are intended for use as aerosol-forming substrates in heated aerosol-generating articles, layers of homogenised tobacco material may have an aerosol former content of between about 5% and about 30% by weight on a dry weight basis. Rods intended for use in electrically-operated aerosol-generating system having a heating element may preferably include homogenised tobacco having an aerosol former content of greater than 5% to about 30%. For rods intended for use in electrically-operated aerosol-generating system having a heating element, the aerosol former may preferably be glycerine.

Layers of homogenised tobacco material for use in forming rods as described herein are preferably formed by a casting process of the type generally comprising casting a slurry comprising particulate tobacco and one or more binders onto a sheet of thermally-conductive material, and drying the cast slurry to form a co-laminated sheet of homogenised tobacco material and thermally-conductive.

Co-laminated sheets material may be textured using suitable known machinery for texturing filter tow, paper and other materials.

For example, co-laminated sheets of material for forming rods as described herein may be crimped using a crimping unit of the type described in CH-A-691156, which comprises a pair of rotatable crimping rollers. However, it will be appreciated that sheets of homogenised tobacco material may be textured using other suitable machinery and processes that deform or perforate the sheets.

Rods according to the specification may be produced from co-laminated sheets of material having different dimensions depending upon their intended use. Co-laminated sheets of material should be of sufficient width to be gathered to form a rod as described herein.

Preferably, co-laminated sheets of material for use in rods as described herein have a width of at least about 25 mm.

In certain embodiments co-laminated sheets of material for use in rods as described herein may have a width of between about 25 mm and about 300 mm.

Preferably, the co-laminated sheets of material that make up the rod have a thickness of at least about 50 μm to about 300 μm.

In certain embodiments, co-laminated sheets of material may have a thickness of between 10 μm and about 250 μm.

Specific embodiments will be further described, by way of example only, with reference to the accompanying drawings in which.

Figure 1:
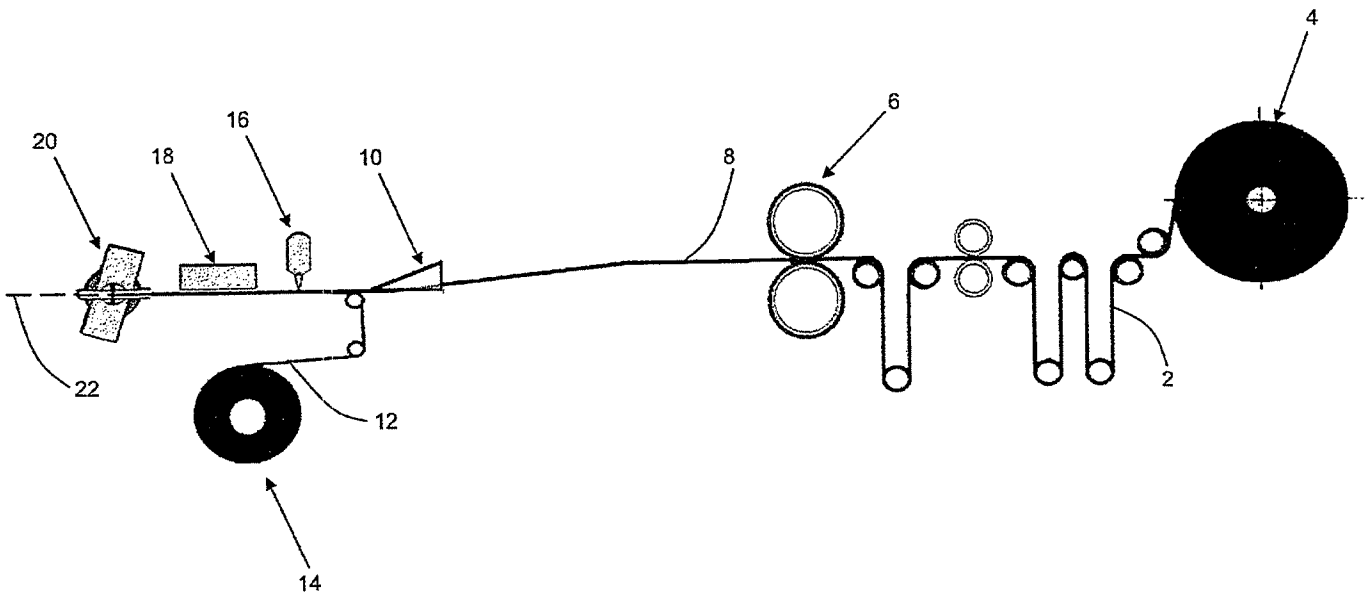
FIG. 1 shows a schematic cross-section of apparatus for forming a rod according to a specific embodiment.

The apparatus shown in FIG. 1 generally comprises: supply means for providing a continuous co-laminated sheet of homogenised tobacco and aluminium foil; crimping means for crimping the continuous co-laminated sheet; rod forming means for gathering the continuous crimped co-laminated sheet and circumscribing the gathered material with a metal foil wrapper to form a continuous rod; and cutting means for severing the continuous rod into a plurality of discrete rods. The apparatus also comprises transport means for transporting the continuous co-laminated sheet of material downstream through the apparatus from the supply means to the rod forming means via the crimping means.

As shown in FIG. 1, the supply means for providing a continuous co-laminated sheet comprises a continuous co-laminated sheet of homogenised tobacco and aluminium foil 2 mounted on a bobbin 4. The crimping means comprises a pair of rotatable crimping rollers 6. In use, the continuous co-laminated sheet of homogenised tobacco and aluminium foil 2 is drawn from the first bobbin 4 and transported downstream to the pair of crimping rollers 6 by the transport mechanism via a series of guide and tensioning rollers. As the continuous co-laminated sheet of homogenised tobacco and aluminium foil 2 is fed between the pair of crimping rollers 6, the crimping rollers engage and crimp the sheet 2 to form a continuous crimped co-laminated sheet of homogenised tobacco and aluminium foil 8 having a plurality of spaced-apart ridges or corrugations substantially parallel to the longitudinal axis of the sheet through the apparatus.

The continuous crimped sheet of homogenised tobacco material 8 is transported downstream from the pair of crimping rollers 6 towards the rod forming means and fed through a converging funnel or horn 10. The converging funnel 10 gathers the continuous co-laminated sheet of homogenised tobacco and aluminium foil 8 transversely relative to its longitudinal axes. The sheet of material 8 assumes a substantially cylindrical configuration as it passes through the converging funnel 10.

Upon exiting the converging funnel 10, the gathered co-laminated sheet of homogenised tobacco and aluminium foil is wrapped in a continuous sheet of aluminium foil wrapping material 12. The continuous sheet of aluminium foil wrapping material is fed from a bobbin 14 and enveloped around the gathered continuous crimped sheet of homogenised tobacco material by an endless belt conveyor or garniture. As shown in FIG. 1, the rod forming means comprises an adhesive application means 16 that applies adhesive to one of the longitudinal edges of the continuous sheet of wrapping material, so that when the opposed longitudinal edges of the continuous sheet of aluminium foil wrapping material are brought into contact they adhere to one other to form a continuous rod.

The rod forming means further comprises a drying means 18 downstream of the adhesive application means 16, which in use dries the adhesive applied to the seam of the continuous rod as the continuous rod is transported downstream from the rod forming means to the cutting means.

The cutting means comprises a rotary cutter 20 that severs the continuous rod into a plurality of discrete rods of unit rod length or multiple unit rod length.

Figure 2:
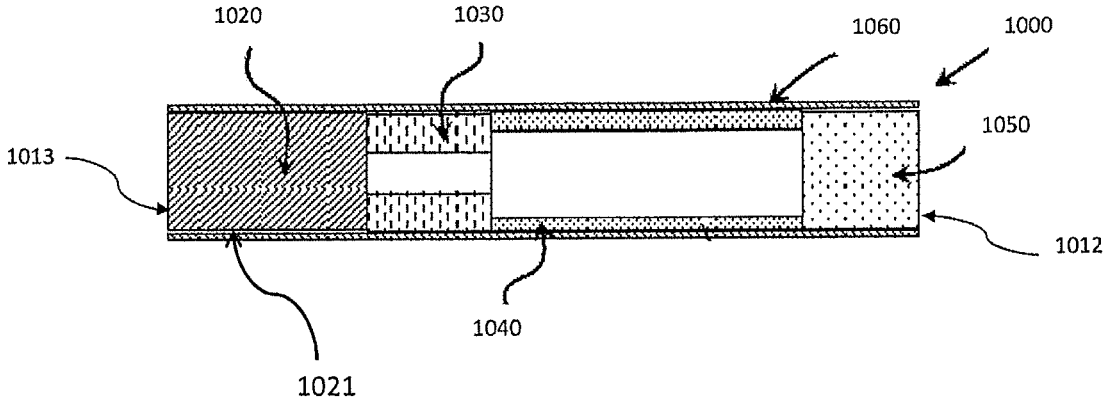
FIG. 2 illustrates an embodiment of an aerosol-generating article as described herein.

FIG. 2 illustrates an embodiment of an aerosol-generating article 1000 comprising a rod as described herein. The article 1000 comprises four elements; a rod 1020 of an aerosol-forming substrate 1020, a hollow cellulose acetate tube 1030, a spacer element 1040, and a mouthpiece filter 1050. These four elements are arranged sequentially and in coaxial alignment and are circumscribed by a cigarette paper 1060 to form the aerosol-generating article 1000. The article 1000 has a mouth-end 1012, which a user inserts into his or her mouth during use, and a distal end 1013 located at the opposite end of the article to the mouth end 1012. The embodiment of an aerosol-generating article illustrated in FIG. 2 is particularly suitable for use with an electrically-operated aerosol-generating device comprising a heater for heating the aerosol-forming substrate.

When assembled, the article 1000 is about 45 millimetres in length and has an outer diameter of about 7.2 millimetres and an inner diameter of about 6.9 millimetres.

The aerosol-forming substrate 1020 comprises a rod formed from a co-laminated sheet of homogenised tobacco and aluminium foil wrapped in aluminium foil 1021 to form a plug. The wrapper 1021 may be any metal foil. The wrapper 1021 may alternatively be a standard filter paper. A user may inadvertently attempt to ignite the aerosol-forming substrate 1020 by applying a flame to the distal end 1013 and simultaneously drawing air through the mouthpiece. Should this occur, the aluminium foil component of the co-laminated sheet will swiftly spread the applied heat throughout the aerosol-forming substrate, thereby making it more difficult to increase the homogenised tobacco component to its ignition temperature. This lowered propensity for ignition may be sufficient for the user to desist in the attempts to ignite the article.

An aerosol-generating article 1000 as illustrated in FIG. 2 is designed to engage with an aerosol-generating device in order to be consumed. Such an aerosol-generating device includes means for heating the aerosol-forming substrate 1020 to a sufficient temperature to form an aerosol. Typically, the aerosol-generating device may comprise a heating element that surrounds the aerosol-generating article 1000 adjacent to the aerosol-forming substrate 1020, or a heating element that is inserted into the aerosol-forming substrate 1020.

Once engaged with an aerosol-generating device, a user draws on the mouth-end 1012 of the smoking article 1000 and the aerosol-forming substrate 1020 is heated to a temperature of about 375 degrees Celsius. At this temperature, volatile compounds are evolved from the sheet of cast-leaf tobacco of the aerosol-forming substrate 1020. These compounds condense to form an aerosol. The aerosol is drawn through the filter 1050 and into the user's mouth.

Figure 3:
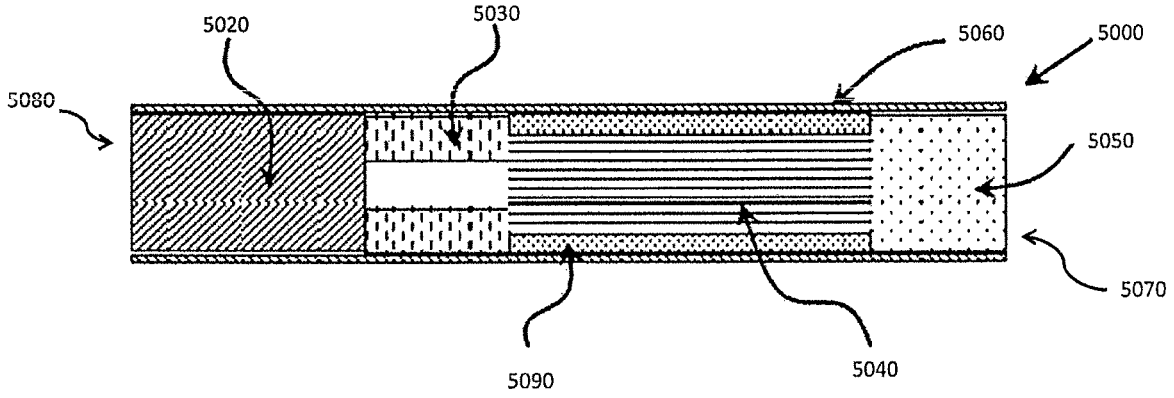
FIG. 3 illustrates an alternative embodiment of an aerosol-generating article as described herein.

FIG. 3 illustrates a further alternative configuration of an aerosol-generating article 5000. The aerosol-generating article 5000 comprises four elements arranged in coaxial alignment: an aerosol-forming substrate 5020, a support element 5030, an aerosol-cooling element 5040, and a mouthpiece 5050. These four elements are arranged sequentially and are circumscribed by an outer wrapper 5060 to form the aerosol-generating article 5000. The aerosol-cooling element 5040 acts as a spacer element as described in relation to FIG. 2 as well as an aerosol-cooling element. In use, volatile substances released from the aerosol-forming substrate 5020 pass along the aerosol-cooling element 5040 towards a mouth end 5012 of the aerosol-generating article 5000. The volatile substances may cool within the aerosol-cooling element 5040 to form an aerosol that is inhaled by the user. In the embodiment illustrated in FIG. 5, the aerosol-cooling element comprises a crimped and gathered sheet of polylactic acid circumscribed by a wrapper. The aerosol-forming substrate 5020 is in the form of a rod 5020 formed from a co-laminated sheet of homogenised tobacco and aluminium foil wrapped in a wrapper to form a plug. The wrapper may be a metal foil such as an aluminium foil. The aerosol-generating 5000 has a proximal or mouth end 5070, which a user inserts into his or her mouth during use, and a distal end 5080 located at the opposite end of the aerosol-generating article 5000 to the mouth end 5070.

Figure 4:
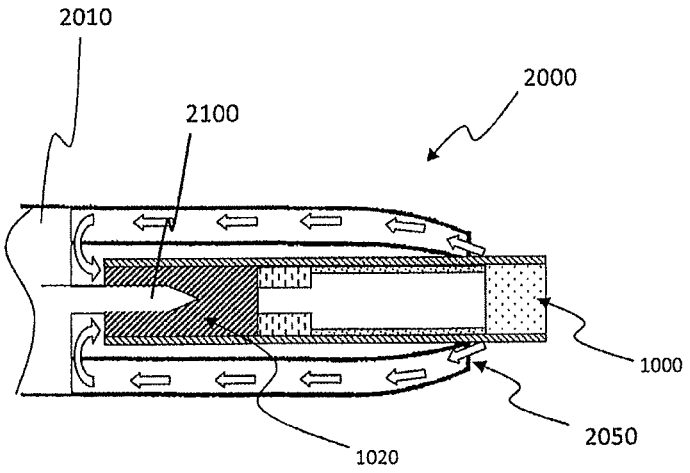
FIG. 4 illustrates an aerosol-generating system comprising an electrically-operated aerosol-generating device and an aerosol-generating article as illustrated in FIG. 2.
Figure 5:
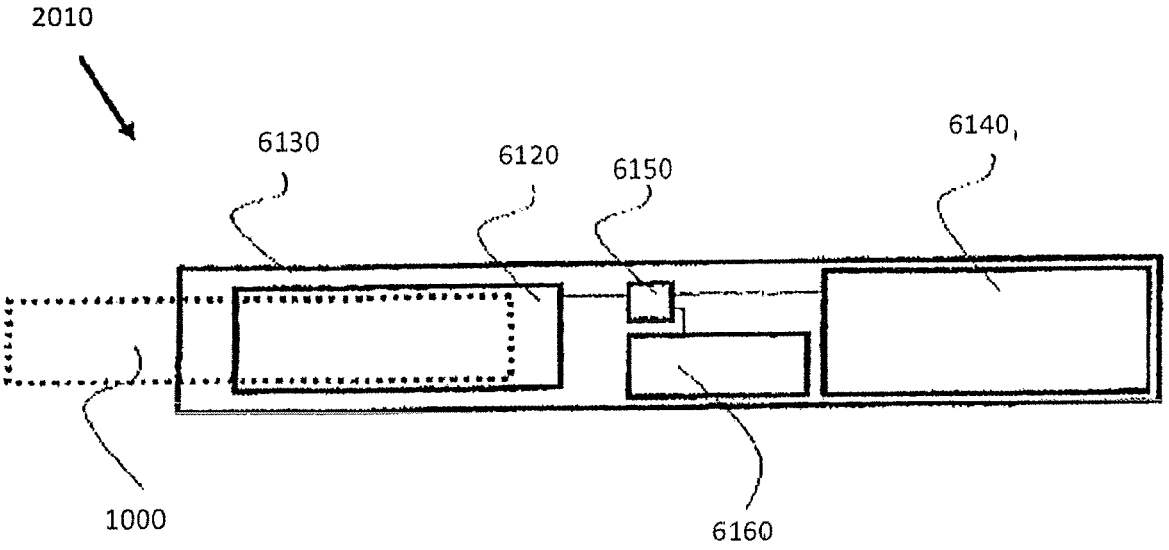
FIG. 5 is a schematic cross-sectional diagram of the electrically-operated aerosol-generating device illustrated in FIG. 3.

FIG. 4 illustrates a portion of an electrically-operated aerosol-generating system 2000 that utilises a heating blade 2100 to heat an aerosol-generating substrate 1020 of an aerosol-generating article 1000. The heating blade is mounted within an aerosol article receiving chamber of an electrically-operated aerosol-generating device 2010. The aerosol-generating device defines a plurality of air holes 2050 for allowing air to flow to the aerosol-generating article 1000. Air flow is indicated by arrows on FIG. 4. The aerosol-generating device comprises a power supply and electronics, which are illustrated in FIG. 5. The aerosol-generating article 1000 of FIG. 3 is as described in relation to FIG. 2.

In FIG. 5, the components of the aerosol-generating device 2010 are shown in a simplified manner. Particularly, the components of the aerosol-generating device 2010 are not drawn to scale in FIG. 5. Components that are not relevant for the understanding of the embodiment have been omitted to simplify FIG. 5.

As shown in FIG. 5, the aerosol-generating device 2010 comprises a housing 6130. The heating element 6120 is mounted within an aerosol-generating article receiving chamber within the housing 6130. The aerosol-generating article 1000 (shown by dashed lines in FIG. 5) is inserted into the aerosol-generating article receiving chamber within the housing 6130 of the aerosol-generating device 2010 such that the heating element 6120 is directly inserted into the aerosol-forming substrate 1020 of the aerosol-generating article 1000.

Within the housing 6130 there is an electrical energy supply 6140, for example a rechargeable lithium ion battery. A controller 6150 is connected to the heating element 6120, the electrical energy supply 6140, and a user interface 6160, for example a button or display. The controller 6150 controls the power supplied to the heating element 6120 in order to regulate its temperature.

The exemplary embodiments described above are not limiting. In view of the above-discussed exemplary embodiments, other embodiments consistent with the above exemplary embodiment will now be apparent to one of ordinary skill in the art.

The invention claimed is:

1. A heated aerosol-generating article, comprising a combustible heat source and an aerosol-forming substrate comprising a rod located downstream of the combustible heat source, the rod comprising:

a gathered sheet of material that is convoluted, folded, or otherwise compressed or constricted substantially transversely to a cylindrical axis of the rod and is circumscribed by a wrapper, wherein the gathered sheet of material is a co-laminated sheet comprising a layer of an aerosol-forming material and a layer of a thermally-conductive material, wherein the gathered sheet of material extends along substantially an entire length of the rod and across substantially an entire transverse cross-sectional area of the rod, and wherein the wrapper is a metal foil.

2. The heated aerosol-generating article according to claim 1, wherein the thermally-conductive material is a metal foil.

3. The heated aerosol-generating article according to claim 1, wherein the metal foil of the wrapper and/or the thermally-conductive material is aluminium foil.

4. The heated aerosol-generating article according to claim 1, wherein the aerosol-forming material comprises tobacco.

5. The heated aerosol-generating article according to claim 1, wherein the co-laminated sheet comprises the layer of the thermally-conductive material sandwiched between two layers of the aerosol-forming material.

6. The heated aerosol-generating article according to claim 1, wherein the co-laminated sheet is textured.

7. The heated aerosol-generating article according to claim 6, wherein the co-laminated sheet is crimped.

8. The heated aerosol-generating article according to claim 1, further comprising one or more further sheets of material, gathered together with the co-laminated sheet and circumscribed by the wrapper.

9. A method of forming a heated aerosol-generating article, comprising a combustible heat source and an aerosol-forming substrate comprising a discrete rod located downstream of the combustible heat source, the method comprising:

providing a continuous co-laminated sheet of material comprising a layer of an aerosol-forming material and a layer of a thermally-conductive material;

gathering the co-laminated sheet of material such that it is convoluted, folded, or otherwise compressed or constricted substantially transversely relative to its longitudinal axis;

circumscribing the gathered co-aminated sheet of material with a metal foil wrapper to form a continuous rod, wherein the gathered co-laminated sheet of material extends along substantially an entire length of the continuous rod and across substantially an entire transverse cross-sectional area of the continuous rod; and severing the continuous rod into a plurality of discrete rods.

10. A heated aerosol-generating article for an electrically-heated aerosol-generating system comprising an aerosol-forming substrate, the substrate comprising a rod, the rod comprising:

a gathered sheet of material that is convoluted, folded, or otherwise compressed or constricted substantially transversely to a cylindrical axis of the rod and is circumscribed by a wrapper, wherein the gathered sheet of material is a co-laminated sheet comprising a layer of an aerosol-forming material and a layer of a thermally-conductive material, wherein the gathered sheet of material extends along substantially an entire length of the rod and across substantially an entire transverse cross-sectional area of the rod, and wherein the wrapper is a metal foil.

11. The heated aerosol-generating article according to claim 10, wherein the thermally-conductive material is a metal foil.

12. The heated aerosol-generating article according to claim 10, wherein the metal foil of the wrapper and/or the thermally-conductive material is aluminium foil.

13. The heated aerosol-generating article according to claim 10, wherein the aerosol-forming material comprises tobacco.

14. The heated aerosol-generating article according to claim 10, wherein the co-laminated sheet comprises the layer of the thermally-conductive material sandwiched between two layers of the aerosol-forming material.

15. The heated aerosol-generating article according to claim 10, wherein the co-laminated sheet is textured.

16. The heated aerosol-generating article according to claim 15, wherein the co-laminated sheet is crimped.

17. The heated aerosol-generating article according to claim 10, further comprising one or more further sheets of material, gathered together with the co-laminated sheet and circumscribed by the wrapper.

* * * * *